US008269548B2

(12) United States Patent
Huang

(10) Patent No.: US 8,269,548 B2
(45) Date of Patent: Sep. 18, 2012

(54) ZERO-TEMPERATURE-COEFFICIENT VOLTAGE OR CURRENT GENERATOR

(75) Inventor: Chun-Jen Huang, New Taipei (TW)

(73) Assignee: Princeton Technology Corporation, Xindian Dist., New Taipei (TW)

( * ) Notice: Subject to any disclaimer, the term of this patent is extended or adjusted under 35 U.S.C. 154(b) by 8 days.

(21) Appl. No.: 13/081,472

(22) Filed: Apr. 6, 2011

(65) Prior Publication Data

US 2011/0248747 A1 Oct. 13, 2011

(30) Foreign Application Priority Data

Apr. 8, 2010 (TW) ..... 99110937 A

(51) Int. Cl.
*H01L 35/00* (2006.01)

(52) U.S. Cl. ..... 327/513; 327/378

(58) Field of Classification Search ..... None
See application file for complete search history.

(56) References Cited

U.S. PATENT DOCUMENTS 8,102,201 B2 * 1/2012 Marinca ..... 327/539
8,120,415 B2 * 2/2012 Conte et al. ..... 327/539

* cited by examiner

*Primary Examiner* — Lincoln Donovan
*Assistant Examiner* — Sibin Chen
(74) *Attorney, Agent, or Firm* — Winston Hsu; Scott Margo

(57) ABSTRACT

General speaking, a resistor of high resistivity has a negative-temperature-coefficient and a resistor of low resistivity has a positive-temperature-coefficient. Utilizing this characteristic, an appropriate proportion between the above resistors can be found to make a combined resistor with an approximate zero-temperature-coefficient. The combined resistor can be used to design a circuit for generating voltage and current with approximate zero-temperature-coefficients.

9 Claims, 2 Drawing Sheets

ZERO-TEMPERATURE-COEFFICIENT VOLTAGE OR CURRENT GENERATOR

BACKGROUND OF THE INVENTION

1. Field of the Invention

The present invention relates to a voltage or current generator, and more particularly, to a zero-temperature-coefficient voltage or current generator.

2. Description of the Prior Art

Generally speaking, an analog circuit often needs a reference voltage circuit not influenced by supply voltage and temperature variation for improving yield of the analog circuit, reliability, and accuracy. The reference voltage circuit is known as a "bandgap reference circuit". The bandgap reference circuit provides a voltage level (bandgap reference voltage) for other function blocks, such as an output voltage level of a regulator, or turning-on or turning-off of a battery charger, and it is a widely used and important circuit. The bandgap reference voltage is generated by adding a proportional to absolute temperature (PTAT) voltage to a complementary to absolute temperature (CTAT) voltage. The CTAT voltage is generated through a base-emitter voltage of a forward-biased bipolar transistor, and the PTAT voltage is generated through using a voltage difference between base-emitter voltages of two bipolar transistors, wherein currents flowing through the two bipolar transistors are the same, but the base-emitter voltages of the two bipolar transistors are different. Thus, the bandgap reference circuit has a low correlation with the supply voltage and process parameters, and the bandgap reference circuit is independent of temperature. Thus, the bandgap reference circuit is widely used in the analog circuits.

Temperature may influence diodes, resistors, capacitors, and transistors to different degrees. However, design of a mixed-signal integrated circuit (IC) requires more complexity, lower voltage and higher speed on an uneven power-density chip, which increases temperature gradient of the chip. Therefore, an IC designer must consider influence of the temperature gradient on the whole chip, because the analog circuits may be very sensitive to the temperature difference, even only a few degrees Celsius. But, current zero temperature-coefficient voltage and current technologies may not consider temperature effect on resistors, so that the reference voltage still correlates with the temperature, and accuracy of the reference voltage is influenced.

SUMMARY OF THE INVENTION

An embodiment of the present invention provides a zero-temperature-coefficient (ZTC) voltage or current generator. The voltage or current generator includes a power amplifier, a first P type metal-oxide-semiconductor, a first PNP type bipolar transistor, a second P type metal-oxide-semiconductor, a group of second PNP type bipolar transistor, a negative-temperature-coefficient resistor, a positive-temperature-coefficient resistor, a first zero-temperature-coefficient combined resistor, a third P type metal-oxide-semiconductor transistor and a second zero-temperature-coefficient combined resistor. The first P type metal-oxide-semiconductor is coupled to an output terminal of the power amplifier. The first PNP type bipolar transistor has an emitter coupled to a negative input terminal of the power amplifier and a drain of the first P type metal-oxide-semiconductor. The second P type metal-oxide-semiconductor is coupled to the output terminal of the power amplifier. Each of the group of second PNP type bipolar transistors has an emitter coupled to a positive input terminal of the power amplifier and a drain of the second P type metal-oxide-semiconductor. The negative-temperature-coefficient resistor is coupled between the positive input terminal of the power amplifier and the emitter of the each second PNP type bipolar transistor. The first zero-temperature-coefficient combined resistor is coupled to the positive input terminal of the power amplifier. The third P type metal-oxide-semiconductor transistor is coupled to the output terminal of the power amplifier. And the second zero-temperature-coefficient combined resistor is coupled to a drain of the third P type metal-oxide-semiconductor transistor.

Another embodiment of the present invention provides a voltage or current generator with an approximately zero-temperature-coefficient. The voltage or current generator comprises a power amplifier, a first P type metal-oxide-semiconductor, a first NPN type bipolar transistor, a second P type metal-oxide-semiconductor, a group of second NPN type bipolar transistor, a negative-temperature-coefficient resistor, a first zero-temperature-coefficient combined resistor, a third P type metal-oxide-semiconductor transistor and a second zero-temperature-coefficient combined resistor. The first P type metal-oxide-semiconductor is coupled to an output terminal of the power amplifier. The first NPN type bipolar transistor comprises a collector coupled to a negative input terminal of the power amplifier and a drain of the first P type metal-oxide-semiconductor transistor. The second P type metal-oxide-semiconductor is coupled to the output terminal of the power amplifier. Each of the group of second NPN type bipolar transistors comprises a collector coupled to a positive input terminal of the power amplifier and a drain of the second P type metal-oxide-semiconductor transistor. The negative-temperature-coefficient resistor is coupled between the positive input terminal of the power amplifier and the collector of the each second NPN type bipolar transistor. The positive-temperature-coefficient resistor is coupled between the positive input terminal of the power amplifier and the collector of the each second NPN type bipolar transistor. The first zero-temperature-coefficient combined resistor is coupled to the positive input terminal of the power amplifier. The third P type metal-oxide-semiconductor transistor is coupled to the output terminal of the power amplifier. And the second zero-temperature-coefficient combined resistor is coupled to a drain of the third P type metal-oxide-semiconductor transistor.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
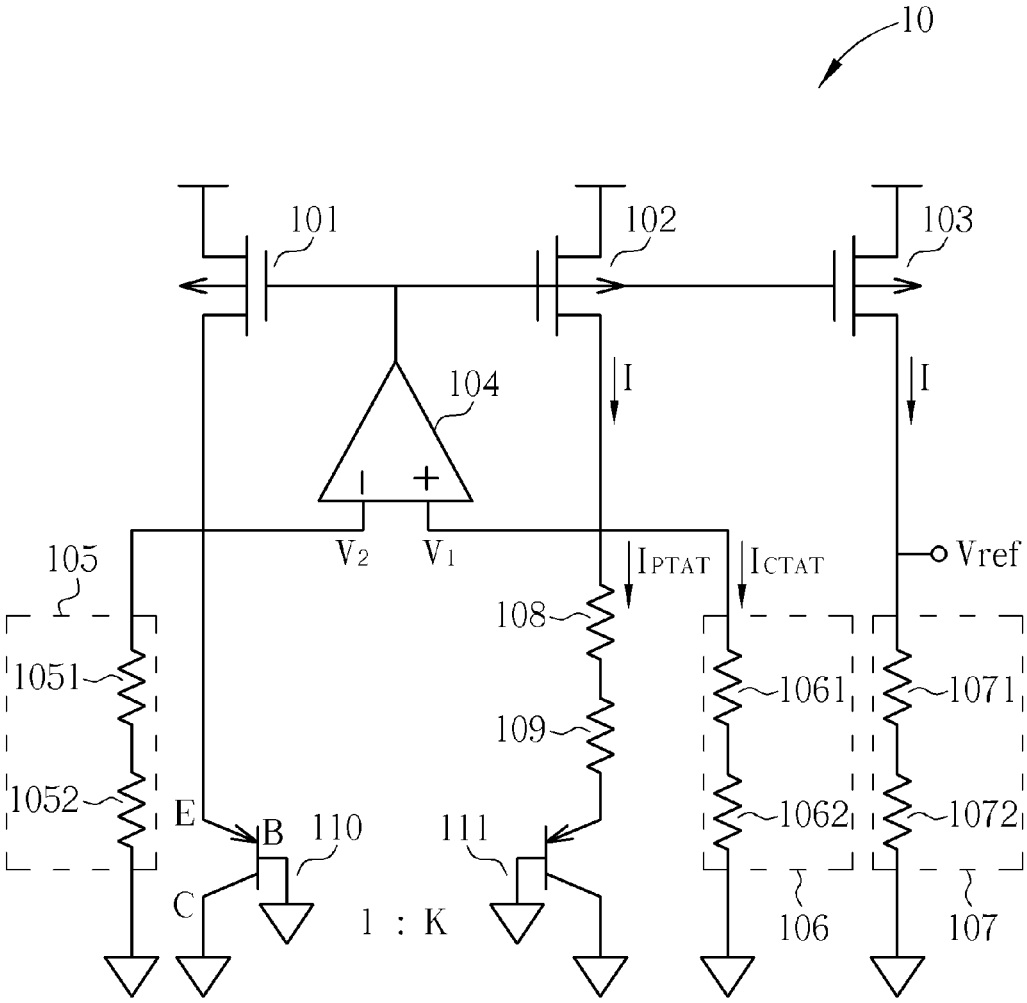
FIG. 1 is a diagram illustrating a voltage or current generator with a zero-temperature-coefficient according to an embodiment of the present invention.

Please refer to FIG. 1. FIG. 1 is a diagram illustrating a voltage or current generator 10 with an approximately zero-temperature-coefficient according to an embodiment of the present invention. The voltage or current generator 10 comprises a first P type metal-oxide-semiconductor 101, a second P type metal-oxide-semiconductor 102, a third P type metal-oxide-semiconductor transistor 103, a power amplifier 104, a third zero-temperature-coefficient combined resistor 105, a first zero-temperature-coefficient combined resistor 106, a second zero-temperature-coefficient combined resistor 107, a negative-temperature-coefficient resistor 108, a positive-temperature-coefficient resistor 109, a first PNP type bipolar transistor 110, and a group of second PNP type bipolar transistors 111. The first zero-temperature-coefficient combined resistor 106 comprises a positive-temperature-coefficient resistor 1062 and a negative-temperature-coefficient resistor 1061; the second zero-temperature-coefficient combined resistor 107 comprises a positive-temperature-coefficient resistor 1072 and a negative-temperature-coefficient resistor 1071; the third zero-temperature-coefficient combined resistor 105 comprises a positive-temperature-coefficient resistor 1052 and a negative-temperature-coefficient resistor 1051. A value of the first zero-temperature-coefficient combined resistor 106 is L*R, a value of the second zero-temperature-coefficient combined resistor 107 is N*R, a value of the third zero-temperature-coefficient combined resistor 105 is L*R, and a value of a combination of the negative-temperature-coefficient resistor 108 and the positive-temperature-coefficient resistor 109 is R. The K first PNP type bipolar transistors 110 connect in parallel to form the group of second PNP type bipolar transistors 111, where K≧1.

As shown in FIG. 1, voltages of two input terminals of the power amplifier 104 are the same when the power amplifier 104 operates normally. That is to say, the voltage of the positive input terminal V1 is the same as the voltage of the negative input terminal V2, so a PTAT current $I_{PTAT}$ is generated as follows:

$$V1 = I_{PTAT} * R + V_{EB,111} \tag{1}$$

$$V2 = V_{EB,110}$$

$$\because V1 = V2$$

$$\Rightarrow I_{PTAT} = \frac{V_{EB,110} - V_{EB,111}}{R} = \frac{V_T * \ln K}{R}$$

$$\because V_T = \frac{kT}{q}$$

$$\Rightarrow I_{PTAT} \propto T$$

In addition, a CTAT current $I_{CTAT}$ is generated as follows:

$$I_{CTAT} = \frac{V_{EB,110}}{L * R} \tag{2}$$

Because $V_{EB,110}$ has a negative-temperature-coefficient and L*R has a zero-temperature-coefficient, $I_{CTAT}$ is a CTAT current. Please refer to equations (1), (2), and (3). A current I with a zero-temperature-coefficient is generated through the equation (1) and the equation (2), then a parameter L is derived from the current I through the equation (3):

$$I = I_{PTAT} + I_{CTAT} = \frac{V_T * \ln K}{R} + \frac{V_{EB,110}}{L * R}$$

$$\frac{\partial I}{\partial T} = \frac{\ln k}{R} * \frac{\partial V_T}{\partial T} - \frac{V_T * \ln K}{R^2} * \frac{\partial R}{\partial T} + \frac{1}{L * R} * \frac{\partial V_{EB,110}}{\partial T} - \frac{V_{EB,110}}{L * R^2} * \frac{\partial R}{\partial T}$$

The value R of the combination of the negative-temperature-coefficient resistor 108 and the positive-temperature-coefficient resistor 109 is independent of temperature, that is $$\frac{\partial R}{\partial T} = 0.$$

Therefore, the above equation can be simplified to the equation (3):

$$\frac{\partial I}{\partial T} = \frac{\ln K}{R} * \frac{\partial V_T}{\partial T} + \frac{1}{L * R} * \frac{\partial V_{EB,110}}{\partial T} \tag{3}$$

$$\Rightarrow L = -\frac{\frac{\partial V_{EB,110}}{\partial T}}{\frac{\partial V_T}{\partial T} \ln K}$$

Therefore, when a ratio of the value of the first zero-temperature-coefficient combined resistor 106 to the value of the combination of the negative-temperature-coefficient resistor 108 and the positive-temperature-coefficient resistor 109 is L, the current I with a zero-temperature-coefficient is generated.

Before discussing a parameter N and a reference voltage $V_{ref}$, please note that the third P type metal-oxide-semiconductor transistor 103 duplicates the current I with a zero-temperature-coefficient. Then, please refer to equation (4):

$$V_{ref} = (I_{PTAT} + I_{CTAT}) * N * R = V_T * \ln K * N + \frac{V_{EB,110}}{L} * N \tag{4}$$

$$\Rightarrow N = -\frac{V_{ref}}{V_T * \ln K + \frac{V_{EB,110}}{L}}$$

Substituting the parameter L generated through equation (3) into equation (4) yields a relationship equation between the parameter N and the reference voltage $V_{ref}$. Referring to equation (4), the reference voltage $V_{ref}$ varies with the parameter N, and is not limited to 1.25V.

A function of the third zero-temperature-coefficient combined resistor 105 is making the circuits viewed from the positive input terminal and the negative input terminal of the power amplifier 104 more symmetrical.

Figure 2:
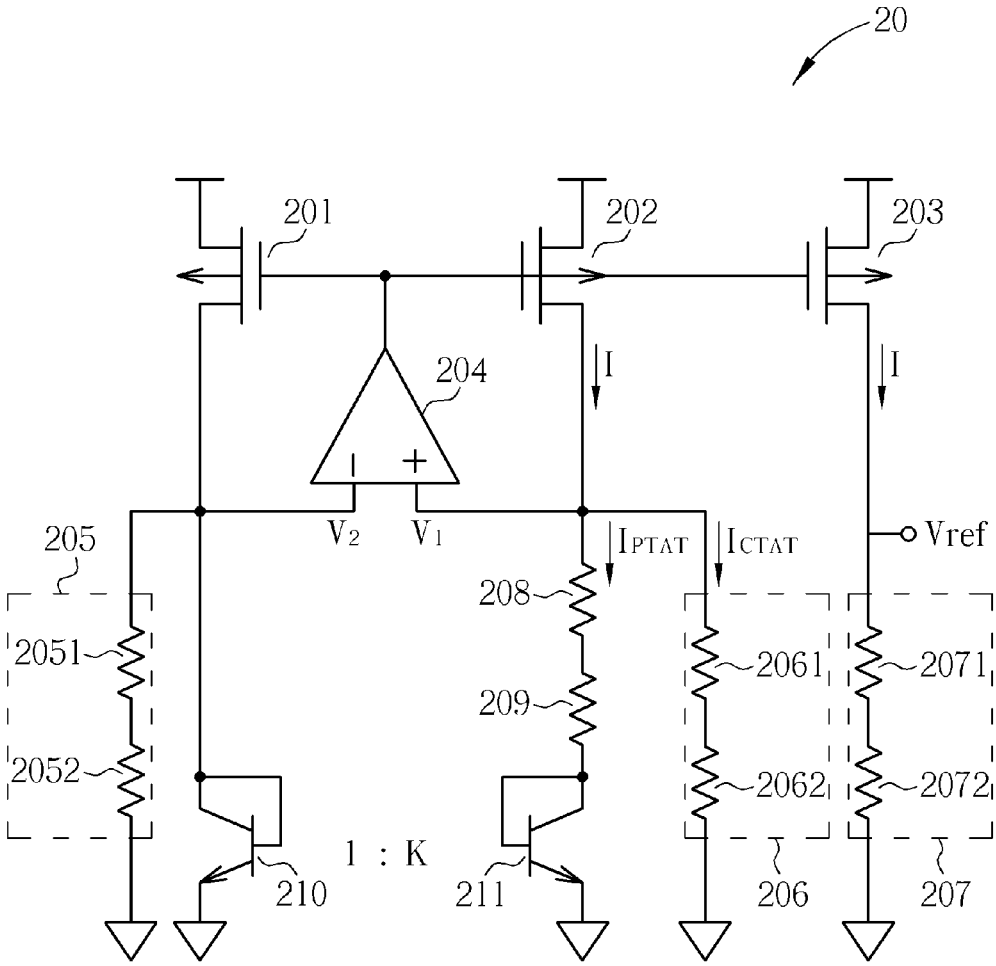
FIG. 2 is a diagram illustrating a voltage or current generator with a zero-temperature-coefficient according to another embodiment of the present invention.

Please refer to FIG. 2. FIG. 2 is a diagram illustrating a voltage or current generator 20 with a zero-temperature-coefficient according to another embodiment of the present invention. The voltage or current generator 20 comprises a first P type metal-oxide-semiconductor 201, a second P type metal-oxide-semiconductor 202, a third P type metal-oxide-semiconductor transistor 203, a power amplifier 204, a third zero-temperature-coefficient combined resistor 205, a first zero-temperature-coefficient combined resistor 206, a second zero-temperature-coefficient combined resistor 207, a negative-temperature-coefficient resistor 208, a positive-temperature-coefficient resistor 209, a first NPN type bipolar transistor 210, and a group of second NPN type bipolar transistors 211. The first zero-temperature-coefficient combined resistor 206 comprises a positive-temperature-coefficient resistor 2062 and a negative-temperature-coefficient resistor 2061; the second zero-temperature-coefficient combined resistor 207 comprises a positive-temperature-coefficient resistor 2072 and a negative-temperature-coefficient resistor 2071; the third zero-temperature-coefficient combined resistor 205 comprises a positive-temperature-coefficient resistor 2052 and a negative-temperature-coefficient resistor 2051. A value of the first zero-temperature-coefficient combined resistor 206 is L*R, a value of the second zero-temperature-coefficient combined resistor 207 is N*R, a value of the third zero-temperature-coefficient combined resistor 205 is L*R, and a value of a combination of the negative-temperature-coefficient resistor 208 and the positive-temperature-coefficient resistor 209 is R. The K first NPN type bipolar transistors 210 connect in parallel to form the group of second NPN type bipolar transistors 211, wherein K≧1.

As shown in FIG. 2, voltages of two input terminals of the power amplifier 204 are the same when the power amplifier 204 operates normally. That is to say, the voltage of the positive input terminal V1 is the same as the voltage of the negative input terminal V2, so a PTAT current $I_{PTAT}$ is generated as follows:

$$V1 = I_{PTAT} * R + V_{BE,211} \tag{5}$$

$$V2 = V_{BE,210}$$

$$\because V1 = V2$$

$$\Rightarrow I_{PTAT} = \frac{V_{BE,210} - V_{BE,211}}{R} = \frac{V_T * \ln K}{R}$$

$$\because V_T = \frac{kT}{q}$$

$$\Rightarrow I_{PTAT} \propto T$$

In addition, a CTAT current $I_{CTAT}$ is generated as follows:

$$I_{CTAT} = \frac{V_{BE,210}}{L * R} \tag{6}$$

Due to $V_{BE,210}$ having a negative-temperature-coefficient and L*R having a zero-temperature-coefficient, $I_{CTAT}$ is a CTAT current. Please refer to equations (5), (6), and (7). A current I with a zero-temperature-coefficient is generated through equation (5) and equation (6), then a parameter L is derived from the current I through equation (7):

$$I = I_{PTAT} + I_{CTAT} = \frac{V_T * \ln K}{R} + \frac{V_{BE,210}}{L * R}$$

$$\frac{\partial I}{\partial T} = \frac{\ln K}{R} * \frac{\partial V_T}{\partial T} - \frac{V_T * \ln K}{R^2} * \frac{\partial R}{\partial T} + \frac{1}{L * R} * \frac{\partial V_{BE,210}}{\partial T} - \frac{V_{BE,210}}{L * R^2} * \frac{\partial R}{\partial T}$$

Because the value R of the combination of the negative-temperature-coefficient resistor 108 and the positive-temperature-coefficient resistor 109 is independent of temperature, that is $$\frac{\partial R}{\partial T} = 0,$$

the above equation can be simplified into the equation (7):

$$\frac{\partial I}{\partial T} = \frac{\ln K}{R} * \frac{\partial V_T}{\partial T} + \frac{1}{L * R} * \frac{\partial V_{BE,210}}{\partial T} \tag{7}$$

$$\Rightarrow L = -\frac{\frac{\partial V_{BE,210}}{\partial T}}{\frac{\partial V_T}{\partial T} \ln K}$$

Therefore, when a ratio of the value of the first zero-temperature-coefficient combined resistor 106 to the value of the combination of the negative-temperature-coefficient resistor 108 and the positive-temperature-coefficient resistor 109 is L, the current I with a zero-temperature-coefficient is generated.

Before discussing a parameter N and a reference voltage $V_{ref}$, please notice the third P type metal-oxide-semiconductor transistor 203 duplicating the current I with a zero-temperature-coefficient. Then please refer to equation (8):

$$V_{ref} = (I_{PTAT} + I_{CTAT}) * N * R = V_T * \ln K * N + \frac{V_{BE,210}}{L} * N \tag{8}$$

$$\Rightarrow N = -\frac{V_{ref}}{V_T * \ln K + \frac{V_{BE,210}}{L}}$$

Substituting the parameter L generated through equation (7) into equation (8) yields an equation describing a relationship between the parameter N and the reference voltage $V_{ref}$. Please refer to equation (8). The reference voltage $V_{ref}$ varies with the parameter N, and is not limited to 1.25V.

A function of the third zero-temperature-coefficient combined resistor 20 makes the circuits seen by the positive input terminal and the negative input terminal of the power amplifier 204 more symmetrical.

To sum up, the bandgap reference circuit can generate a zero-temperature-coefficient reference voltage in theory. However, the bandgap reference circuit is still affected by the temperature when the temperature effect of the resistor is not taken into consideration. The present invention uses the negative-temperature-coefficient resistor and the positive-temperature-coefficient resistor to form the resistor having an approximately zero-temperature-coefficient, so as to reduce the temperature effect on the bandgap reference circuit, and generate a bandgap reference voltage at any voltage level, and a reference current with an approximately zero-temperature-coefficient.

Those skilled in the art will readily observe that numerous modifications and alterations of the device and method may be made while retaining the teachings of the invention.

What is claimed is:

1. A zero-temperature-coefficient (ZTC) voltage or current generator, the generator comprising:

a power amplifier;

a first P type metal-oxide-semiconductor transistor coupled to an output terminal of the power amplifier;

a first diode-connected bipolar transistor coupled to a negative input terminal of the power amplifier and a drain of the first P type metal-oxide-semiconductor transistor;

a second P type metal-oxide-semiconductor transistor coupled to the output terminal of the power amplifier;

a group of second diode-connected bipolar transistors, each second diode-connected bipolar transistor coupled to a positive input terminal of the power amplifier and a drain of the second P type metal-oxide-semiconductor;

a negative-temperature-coefficient resistor coupled between the positive input terminal of the power amplifier and each second diode-connected bipolar transistor;

a first zero-temperature-coefficient combined resistor coupled to the positive input terminal of the power amplifier;

a third P type metal-oxide-semiconductor transistor coupled to the output terminal of the power amplifier; and a second zero-temperature-coefficient combined resistor coupled to a drain of the third P type metal-oxide-semiconductor transistor.

2. The voltage or current generator of claim 1, further comprising:

a third zero-temperature-coefficient combined resistor coupled to a drain of the first P type metal-oxide-semiconductor;

wherein the third zero-temperature-coefficient combined resistor is coupled between the drain of the first P type metal-oxide-semiconductor transistor and a ground;

wherein the third zero-temperature-coefficient combined resistor includes a positive-temperature-coefficient resistor and a negative-temperature-coefficient resistor.

3. The voltage or current generator of claim 1, wherein the first zero-temperature-coefficient combined resistor comprises a positive-temperature-coefficient resistor and a negative-temperature-coefficient resistor; wherein the second zero-temperature-coefficient combined resistor comprises a positive-temperature-coefficient resistor and a negative-temperature-coefficient resistor.

4. The voltage or current generator of claim 1, wherein the first diode-connected bipolar transistor is a PNP type bipolar transistor, and the group of second diode-connected bipolar transistors are PNP type bipolar transistors.

5. The voltage or current generator of claim 4, wherein a source of the first P type metal-oxide-semiconductor, a source of the second P type metal-oxide-semiconductor, and a source of the third P type metal-oxide-semiconductor transistor are coupled to a voltage source; a collector of the first diode-connected bipolar transistor and a collector of each second diode-connected bipolar transistor are coupled to the ground; the first zero-temperature-coefficient combined resistor is coupled between the drain of the second P type metal-oxide-semiconductor transistor and the ground; and the second zero-temperature-coefficient combined resistor is coupled between the drain of the third P type metal-oxide-semiconductor transistor and the ground.

6. The voltage or current generator of claim 4, further comprising:

a positive-temperature-coefficient resistor coupled between the positive terminal of the power amplifier and an emitter of each second diode-connected bipolar transistor;

wherein a zero-temperature-coefficient combined resistor is composed of the positive-temperature-coefficient resistor and the negative-temperature-coefficient resistor.

7. The voltage or current generator of claim 1, wherein the first diode-connected bipolar transistor is an NPN type bipolar transistor, and the group of second diode-connected bipolar transistors are NPN type bipolar transistors.

8. The voltage or current generator of claim 7, wherein a source of the first P type metal-oxide-semiconductor, a source of the second P type metal-oxide-semiconductor, and a source of the third P type metal-oxide-semiconductor transistor are coupled to a voltage source; an emitter of the first diode-connected bipolar transistor and an emitter of each second diode-connected type bipolar transistor are coupled to the ground; the first zero-temperature-coefficient combined resistor is coupled between the drain of the second P type metal-oxide-semiconductor transistor and the ground; and the second zero-temperature-coefficient combined resistor is coupled between the drain of the third P type metal-oxide-semiconductor transistor and the ground.

9. The voltage or current generator of claim 7, further comprising:

a positive-temperature-coefficient resistor coupled between the positive terminal of the power amplifier and a collector of each second diode-connected bipolar transistor;

wherein a zero-temperature-coefficient combined resistor is composed of the positive-temperature-coefficient resistor and the negative-temperature-coefficient resistor.

* * * * *